US008029582B2

(12) United States Patent
Gonze et al.

(10) Patent No.: US 8,029,582 B2
(45) Date of Patent: Oct. 4, 2011

(54) WIRELESS ZONED PARTICULATE MATTER FILTER REGENERATION CONTROL SYSTEM

(75) Inventors: Eugene V. Gonze, Pinckney, MI (US); Michael J. Paratore, Jr., Howell, MI (US); Kevin W. Kirby, Calabasas Hills, CA (US); Amanda Phelps, Malibu, CA (US); Daniel J. Gregoire, Thousand Oaks, CA (US)

(73) Assignee: GM Global Technology Operations LLC

( * ) Notice: Subject to any disclaimer, the term of this patent is extended or adjusted under 35 U.S.C. 154(b) by 400 days.

(21) Appl. No.: 12/191,475

(22) Filed: Aug. 14, 2008

(65) Prior Publication Data

US 2009/0217818 A1 Sep. 3, 2009

Related U.S. Application Data

(60) Provisional application No. 60/973,284, filed on Sep. 18, 2007.

(51) Int. Cl.

| | |
|---|---|
| ***B01D 39/00*** | (2006.01) |
| ***B01D 39/06*** | (2006.01) |
| ***B01D 39/14*** | (2006.01) |
| ***F01N 3/00*** | (2006.01) |
| ***B01D 50/00*** | (2006.01) |

(52) U.S. Cl. ..... 55/282.3; 55/522; 55/523; 55/524; 60/297; 422/169; 422/170; 422/171; 422/172; 422/177; 422/178; 422/179; 422/180; 422/181; 422/182

(58) Field of Classification Search ..... 55/522–524, 55/282.3; 60/297; 422/168–172, 177–182
See application file for complete search history.

(56) References Cited

U.S. PATENT DOCUMENTS

| | | | | |
|---|---|---|---|---|
| 4,505,726 | A | 3/1985 | Takeuchi | |
| 4,516,993 | A | 5/1985 | Takeuchi | |
| 7,469,532 | B2 * | 12/2008 | Williamson et al. | 60/295 |
| 7,513,921 | B1 * | 4/2009 | Phelps et al. | 55/282.3 |
| 2002/0092422 | A1 * | 7/2002 | Ament et al. | 95/148 |
| 2003/0061791 | A1 * | 4/2003 | Barbier et al. | 55/282.3 |
| 2004/0101451 | A1 * | 5/2004 | Ament et al. | 422/173 |
| 2006/0101793 | A1 * | 5/2006 | Gregoire et al. | 55/282.3 |
| 2007/0028765 | A1 * | 2/2007 | Gonze et al. | 95/11 |

* cited by examiner

*Primary Examiner* — Walter D Griffin
*Assistant Examiner* — Amber Orlando

(57) ABSTRACT

An assembly includes a particulate matter (PM) filter that comprises an upstream end for receiving exhaust gas, a downstream end and multiple zones. An absorbing layer absorbs microwave energy in one of N frequency ranges and is arranged with the upstream end. N is an integer. A frequency selective filter has M frequency selective segments and receives microwave energy in the N frequency ranges. M is an integer. One of the M frequency selective segments permits passage of the microwave energy in one of the N frequency ranges and does not permit passage of microwave energy in the other of the N frequency ranges.

19 Claims, 11 Drawing Sheets

WIRELESS ZONED PARTICULATE MATTER FILTER REGENERATION CONTROL SYSTEM

CROSS-REFERENCE TO RELATED APPLICATIONS

This application claims the benefit of U.S. Provisional Application No. 60/973,284, filed on Sep. 18, 2007. The disclosure of the above application is incorporated herein by reference.

STATEMENT OF GOVERNMENT RIGHTS

This disclosure was produced pursuant to U.S. Government Contract No. DE-FC-04-03 AL67635 with the Department of Energy (DoE). The U.S. Government has certain rights in this disclosure.

FIELD

The present disclosure relates to particulate matter (PM) filters, and more particularly to electrically heated PM filters.

BACKGROUND

The statements in this section merely provide background information related to the present disclosure and may not constitute prior art.

Engines such as diesel engines produce particulate matter (PM) that is filtered from exhaust gas by a PM filter. The PM filter is disposed in an exhaust system of the engine. The PM filter reduces emission of PM that is generated during combustion.

Over time, the PM filter becomes full. During regeneration, the PM may be burned within the PM filter. Regeneration may involve heating the PM filter to a combustion temperature of the PM. There are various ways to perform regeneration including modifying engine management, using a fuel burner, using a catalytic oxidizer to increase the exhaust temperature with after injection of fuel, using resistive heating coils, and/or using microwave energy. The resistive heating coils are typically arranged in contact with the PM filter to allow heating by both conduction and convection.

Diesel PM combusts when temperatures above a combustion temperature such as 600° C. are attained. The start of combustion causes a further increase in temperature. While spark-ignited engines typically have low oxygen levels in the exhaust gas stream, diesel engines have significantly higher oxygen levels. While the increased oxygen levels make fast regeneration of the PM filter possible, it may also pose some problems.

PM reduction systems that use fuel tend to decrease fuel economy. For example, many fuel-based PM reduction systems decrease fuel economy by 5%. Electrically heated PM reduction systems reduce fuel economy by a negligible amount. However, durability of the electrically heated PM reduction systems has been difficult to achieve.

SUMMARY

An assembly is provided and includes a particulate matter (PM) filter that comprises an upstream end for receiving exhaust gas, a downstream end and multiple zones. An absorbing layer absorbs microwave energy in one of N frequency ranges and is arranged with the upstream end. N is an integer. A frequency selective filter has M frequency selective segments and receives microwave energy in the N frequency ranges. M is an integer. One of the M frequency selective segments permits passage of the microwave energy in one of the N frequency ranges and does not permit passage of microwave energy in the other of the N frequency ranges.

An assembly is provided and includes a particulate matter (PM) filter that includes an upstream end for receiving exhaust gas, a downstream end and multiple zones. A frequency selective absorbing filter is arranged with the upstream end, receives the exhaust gas, absorbs microwave energy in one of N frequency ranges, and permits transmission of microwave energy in the other of the N frequency ranges into the PM filter. N is an integer.

A method is provided and includes receiving an exhaust gas via a particulate matter (PM) filter that has an upstream end, a downstream end and multiple zones. Microwave energy is generated in one of N frequency ranges. The microwave energy absorption in association with a first zone of the PM filter is permitted. Microwave energy absorption in association with a second zone of said PM filter is limited.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 7:
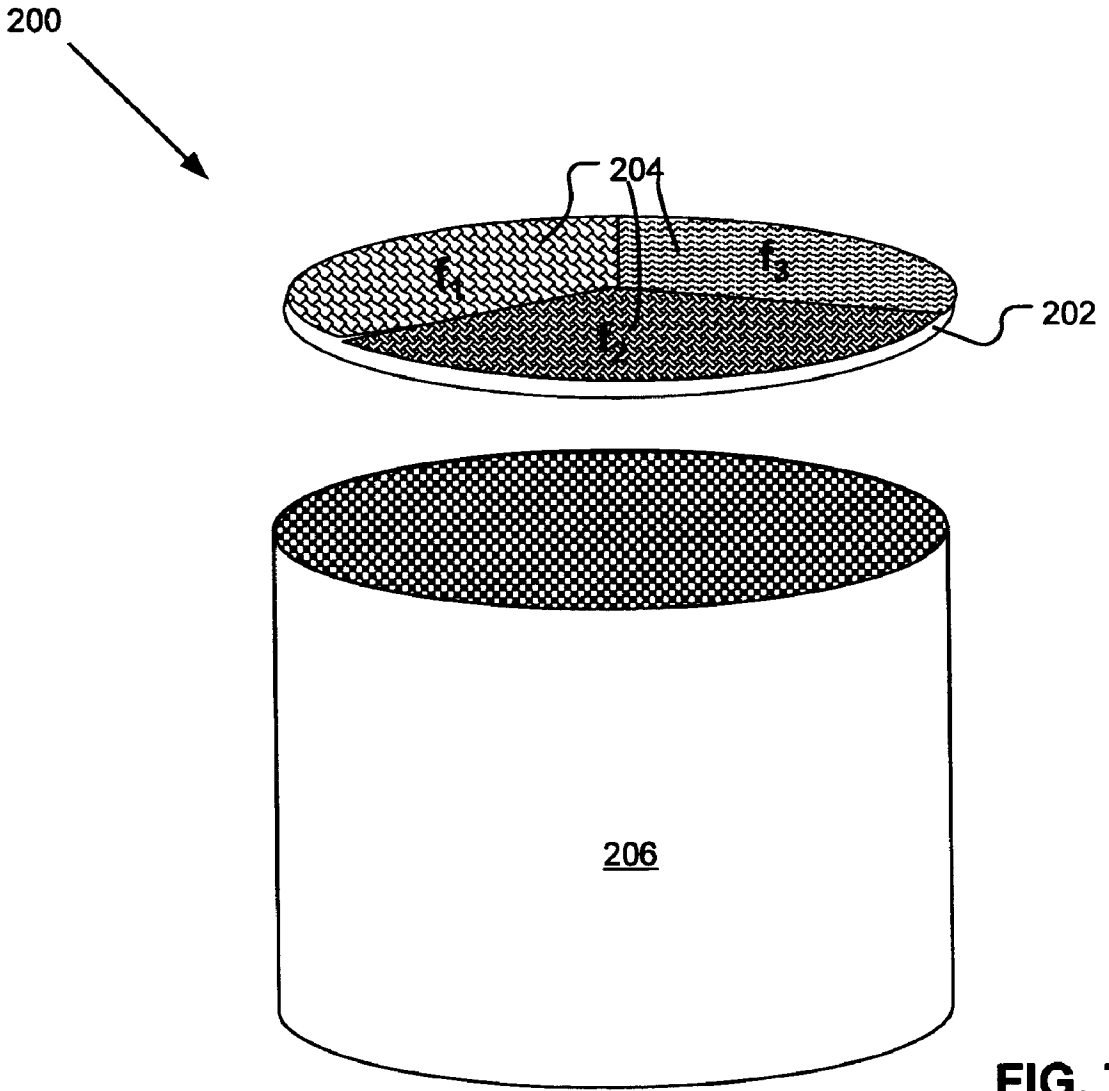
FIG. 7 is a perspective view of a PM filter assembly with a frequency selection absorbing layer in accordance with an embodiment of the present disclosure.
Figure 9:
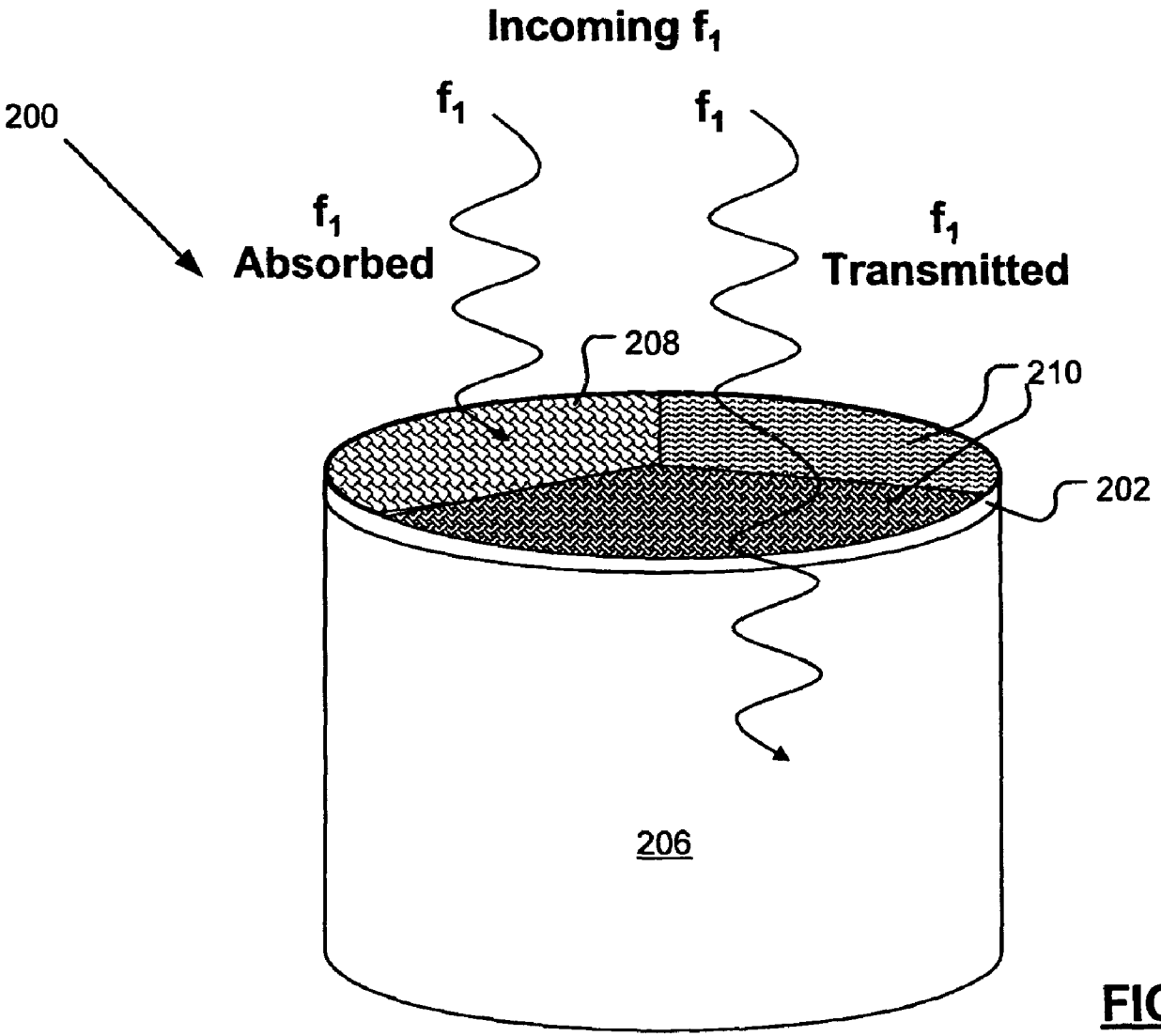
Figure 10:
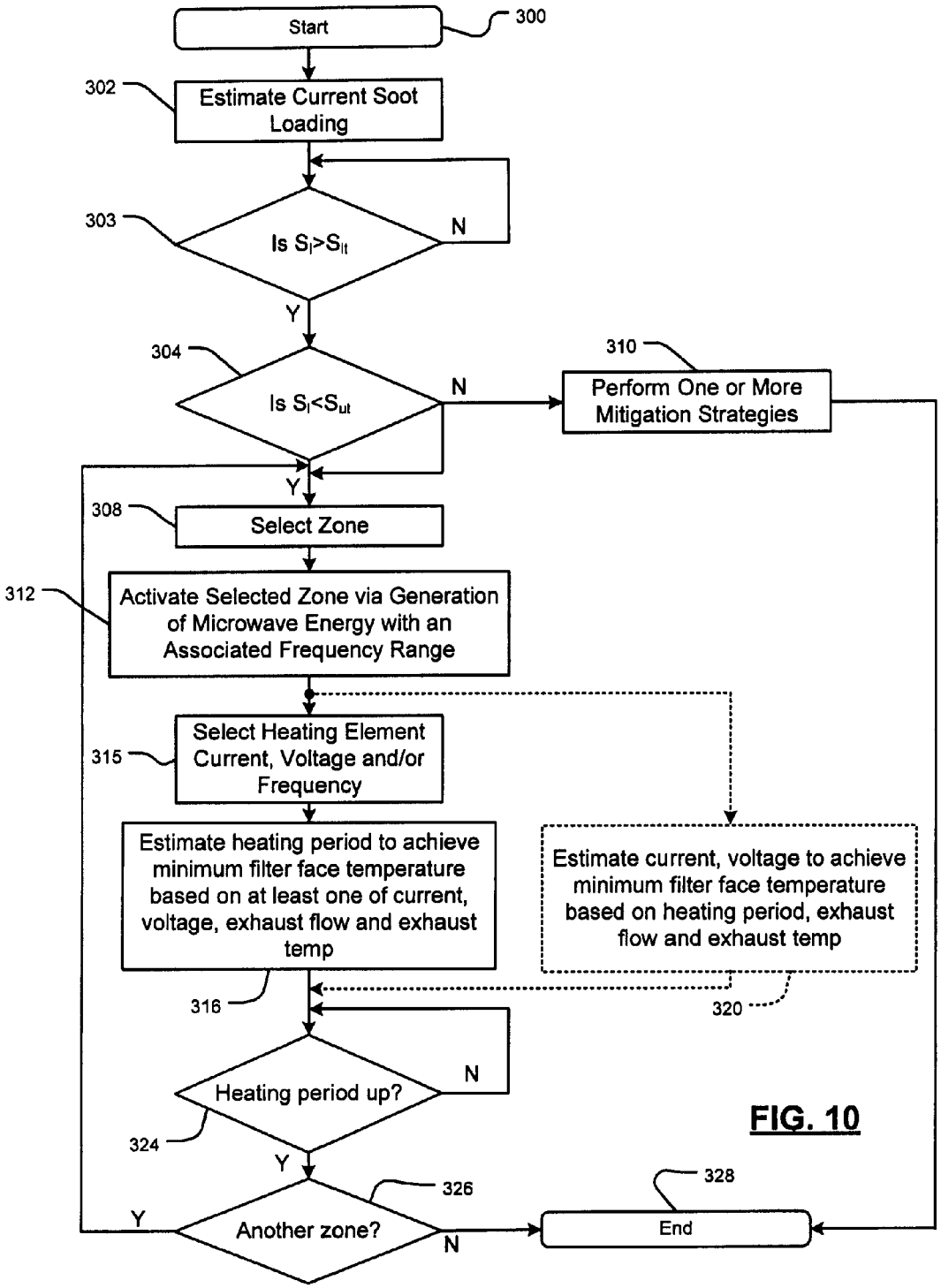
Figure 11:
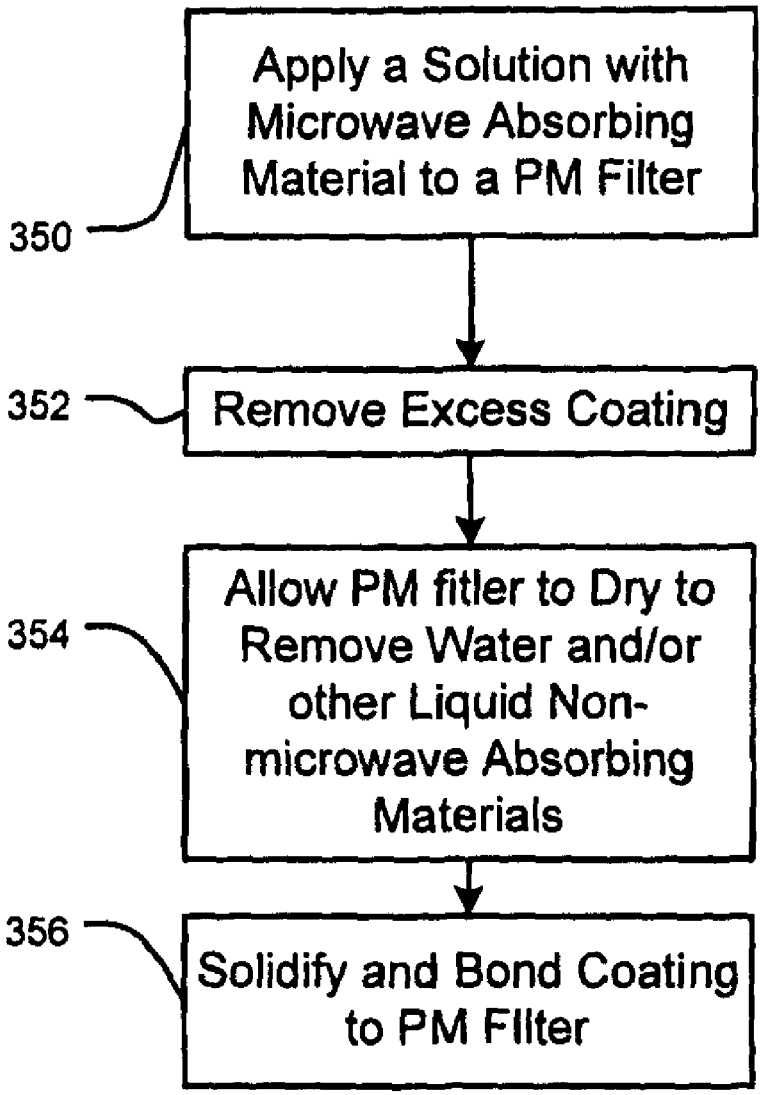

FIG. 9 a perspective view of the PM filter assembly of FIG. 7 illustrating a first frequency absorption;

FIG. 10 is a flowchart illustrating steps performed by the control module to regenerate a zoned PM filter that has microwave heating elements in accordance with an embodiment of the present disclosure; and FIG. 11 is a flowchart illustrating steps performed in manufacturing a PM filter with microwave heating elements.

DETAILED DESCRIPTION

The following description is merely exemplary in nature and is not intended to limit the present disclosure, application, or uses. It should be understood that throughout the drawings, corresponding reference numerals indicate like or corresponding parts and features.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Wireless regeneration refers to the coupling of electromagnetic energy to a PM filter or a PM filter heating assembly without the use of wire contacts. Wireless regeneration may include direct absorption of electromagnetic energy, such as microwave heating and radiative heating.

To reduce power consumption and increase durability of a PM filter during regeneration individual zones may be heated. The individual zones may be heated via different frequency selection absorption techniques, which are described herein.

Figure 1:
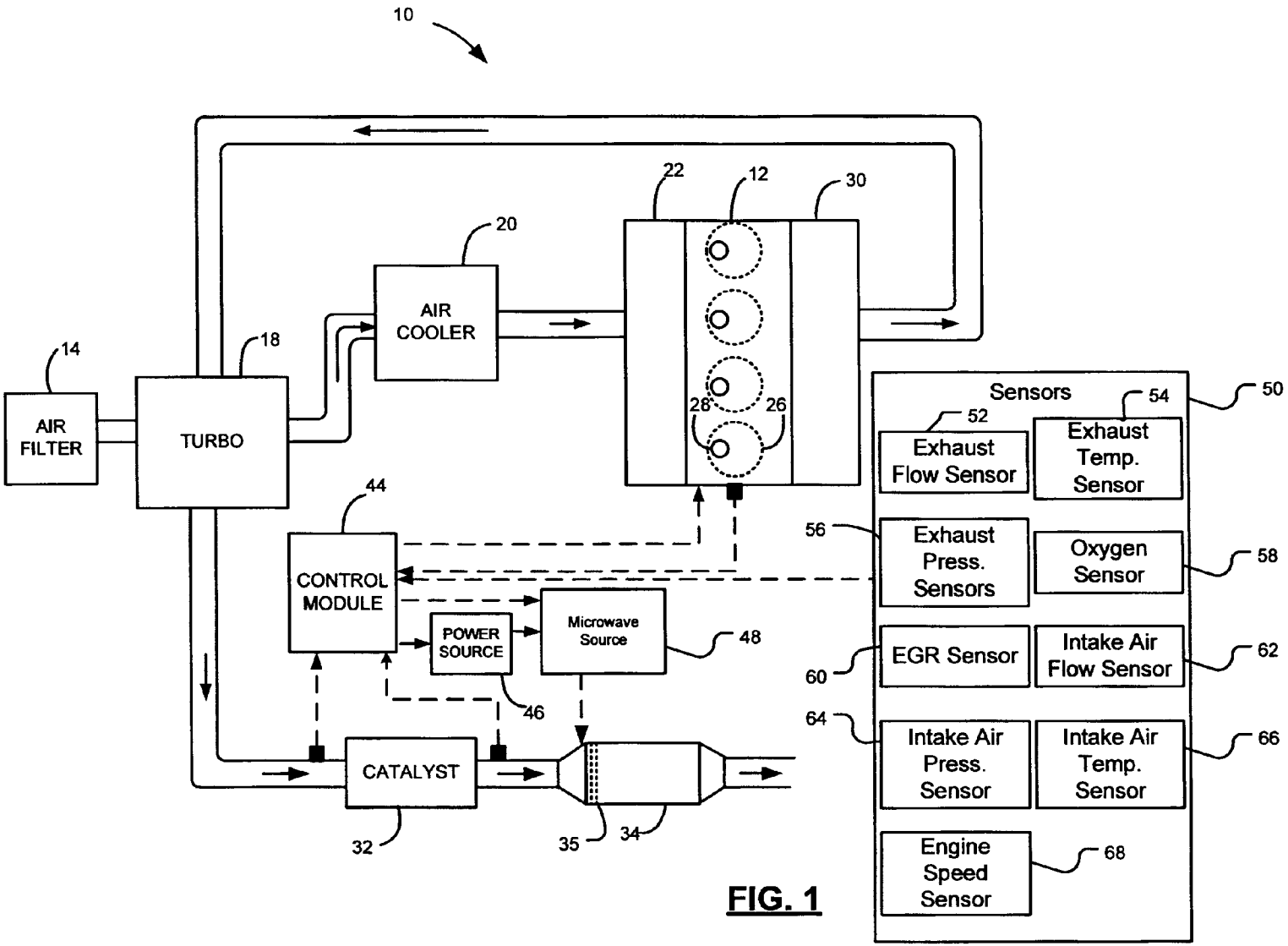
FIG. 1 is a functional block diagram of an exemplary engine system including a particulate matter (PM) filter assembly and a microwave heating circuit in accordance with an embodiment of the present disclosure.

Referring now to FIG. 1, an exemplary diesel engine system 10 is schematically illustrated in accordance with the present disclosure. It is appreciated that the diesel engine system 10 is merely exemplary in nature and that the zone heated particulate filter regeneration system described herein can be implemented in various engine systems implementing a particulate filter. Such engine systems may include, but are not limited to, gasoline direct injection engine systems and homogeneous charge compression ignition engine systems. For ease of the discussion, the disclosure will be discussed in the context of a diesel engine system.

A turbocharged diesel engine system 10 includes an engine 12 that combusts an air and fuel mixture to produce drive torque. Air enters the system by passing through an air filter 14. Air passes through the air filter 14 and is drawn into a turbocharger 18. The turbocharger 18 compresses the fresh air entering the system 10. The greater the compression of the air generally, the greater the output of the engine 12. Compressed air then passes through an air cooler 20 before entering into an intake manifold 22.

Air within the intake manifold 22 is distributed into cylinders 26. Although four cylinders 26 are illustrated, the systems and methods of the present disclosure can be implemented in engines having a plurality of cylinders including, but not limited to, 2, 3, 4, 5, 6, 8, 10 and 12 cylinders. It is also appreciated that the systems and methods of the present disclosure can be implemented in a V-type cylinder configuration. Fuel is injected into the cylinders 26 by fuel injectors 28. Heat from the compressed air ignites the air/fuel mixture. Combustion of the air/fuel mixture creates exhaust. Exhaust exits the cylinders 26 into the exhaust system.

The exhaust system includes an exhaust manifold 30, a diesel oxidation catalyst (DOC) 32, and a particulate matter (PM) filter assembly 34 and a microwave heating circuit 35 for zoned heating of the PM filter. Optionally, an EGR valve (not shown) re-circulates a portion of the exhaust back into the intake manifold 22. The remainder of the exhaust is directed into the turbocharger 18 to drive a turbine. The turbine facilitates the compression of the fresh air received from the air filter 14. Exhaust flows from the turbocharger 18 through the DOC 32 and into the PM filter assembly 34. The DOC 32 oxidizes the exhaust based on the post combustion air/fuel ratio. The amount of oxidation increases the temperature of the exhaust. The PM filter assembly 34 receives exhaust from the DOC 32 and filters any soot particulates present in the exhaust. The microwave heating circuit 35 heats the soot to a regeneration temperature as will be described below.

A control module 44 controls the engine and PM filter regeneration based on various sensed information and soot loading. More specifically, the control module 44 estimates loading of the PM filter assembly 34. When the estimated loading is at a predetermined level and/or the exhaust flow rate is within a desired range, current is controlled to a power source 46, which powers a microwave source 48. This initiates the regeneration process. The microwave source 48 may be, for example, a magnetron. The duration of the regeneration process may be varied based upon the estimated amount of particulate matter within the PM filter assembly 34, the number of zones, etc. The microwave source 48 generates microwave (radio frequency) power based on power received from the power source and control signals received from the control module. The term microwave refers to electromagnetic energy having a frequency higher than 1 gigahertz (billions of cycles per second), corresponding to wavelength shorter than 30 centimeters.

The microwave radiation may have a frequency of approximately between 300 MHz-300 GHz or more specifically between approximately 1 GHz-300 GHz. The microwave energy is passed to the microwave heating circuit, which heats selected sections of the PM filter for predetermined periods. The heat causes soot in the selected sections to reach a point of ignition (light-off) and thus start regeneration. The ignition of the soot creates an exotherm that propagates along the PM filter and heats soot downstream from the heated zone to the point of ignition, continuing the regeneration process.

In one embodiment, the regeneration process is divided up into regeneration periods. Each period is associated with the regeneration within an axial or radial portion of the PM filter. As an example, the control module and/or microwave source selects zones to regenerate with frequency selection of the generated microwave radiation. The duration or length of each period may vary. The activation of a heating element heats soot in an area of a zone. The remainder of the regeneration process associated with that regeneration period is achieved using the heat generated by the heated soot and by the heated exhaust passing through that area and thus involves convective heating. Non-regeneration periods or periods in which microwave energy is not generated may exist between regeneration periods to allow cooling of the PM filter and thus reduction of internal pressures within the PM filter.

The above system may include sensors 50 for determining exhaust flow levels, exhaust temperature levels, exhaust pressure levels, oxygen levels, intake air flow rates, intake air pressure, intake air temperature, engine speed, EGR, etc. An exhaust flow sensor 52, an exhaust temperature sensor 54, exhaust pressure sensors 56, oxygen sensor 58, an EGR sensor 60, an intake air flow sensor 62, an intake air pressure sensor 64, an intake air temperature sensor 66, and an engine speed sensor 68 are shown.

Figure 2:
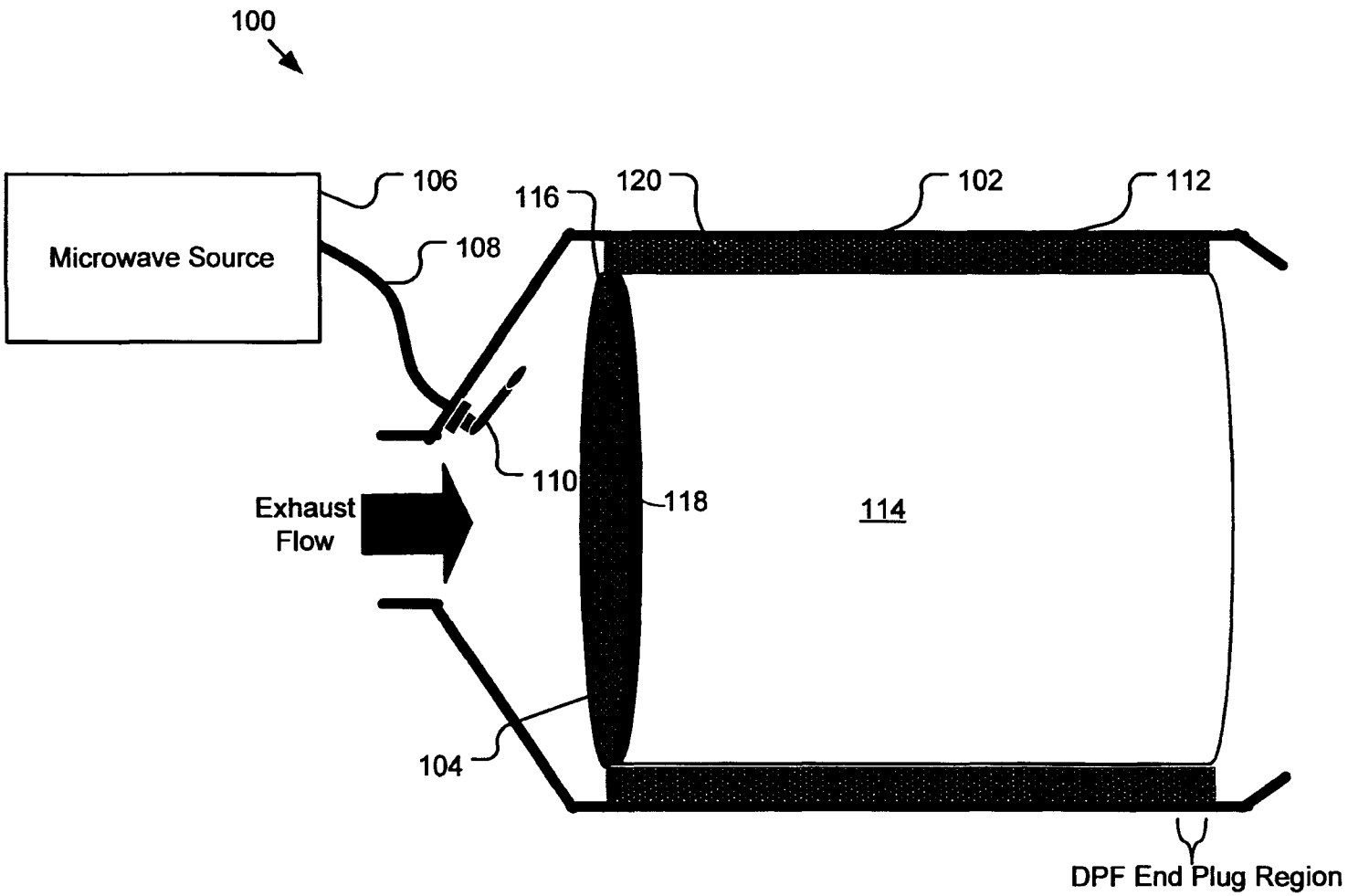
FIG. 2 is a functional block diagram and cross-sectional view of a microwave heating circuit and PM filter assembly that has microwave heating elements in accordance with an embodiment of the present disclosure.

Referring now to FIG. 2, a functional block diagram and cross-sectional view of a microwave heating circuit 100 and PM filter assembly 102 with microwave heating elements 104 is shown. The microwave heating circuit 100 includes a microwave source 106, a waveguide 108 and one or more antennas 110 or other radio frequency energy transmitters. The PM filter assembly 102 includes a housing (can) 112 with a PM filter 114 contained therein. The microwave heating elements 104 are located on, proximate, and/or as part of the PM filter 102. In the embodiment of FIG. 2, the microwave heating element 104 includes a microwave absorber 116. The microwave absorber 116 absorbs microwave power emitted by the antenna 110. In a couple of embodiments of the present disclosure, the microwave heating elements 104 are located on a front inlet surface 118 of the PM filter 114. The PM filter assembly 102 may include a mat 120.

As another example, the PM filter assembly 102 may include as many point sources of microwave energy, each point source having a different frequency, as discrete zones to be heated. To individually heat three different zones, three sources of microwave radiation each having a different frequency output may be used.

A magnetron may be referred to as a self-excited oscillator that is used as a microwave transmitter tube. Magnetrons are characterized by high peak power, small size, efficient operation, and high operating voltage. Magnetrons tend to have a high voltage at a cathode, and hence use a high voltage power supply. Emitted electrons interact with an electric field and a strong magnetic field to generate microwave energy. Because the direction of the electric field that accelerates the electron beam is perpendicular to the axis of the magnetic field, magnetrons are sometimes referred to as crossed-field tubes. A magnetron may include an electric circuit within a strong magnetic field. The magnetic field may be fixed or variable. Electrons are produced at the cathode and are caused to spin in the magnetic field. The effect of their spin is the creation of short-wave radiation. The magnetron contains a cavity, which can be set to resonate at the select frequency of the radiation being produced by the electrons. The select frequency is transmitted as microwaves.

Figure 3:
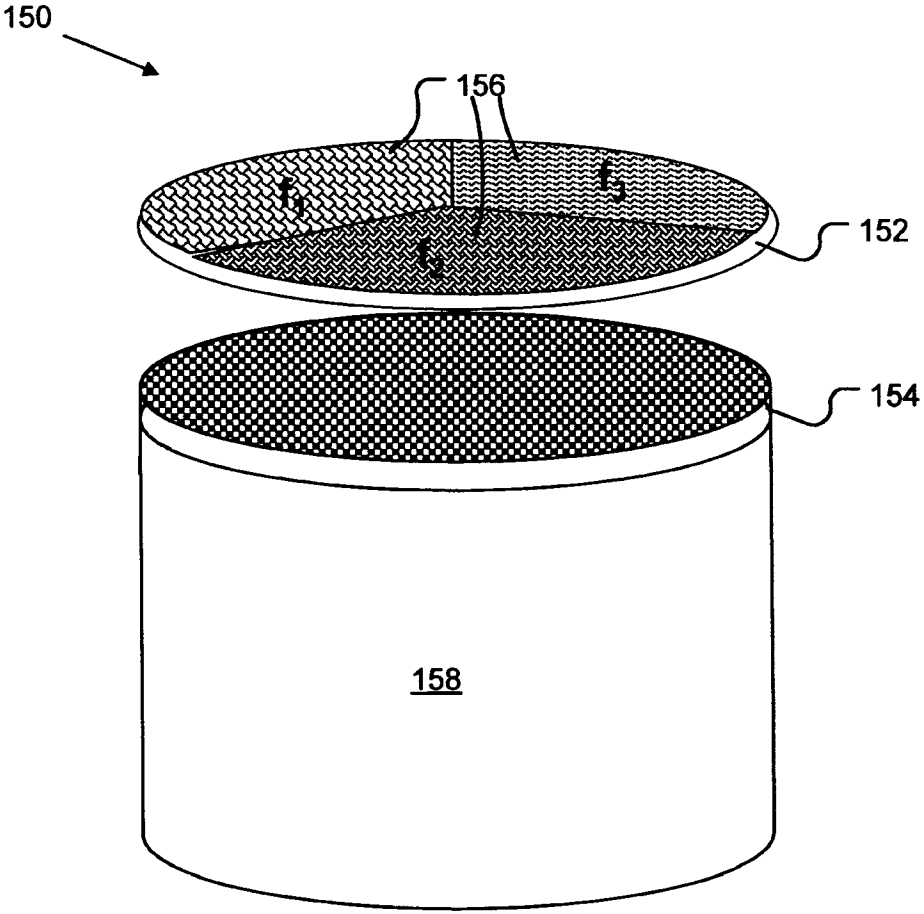
FIG. 3 is a perspective view of a PM filter assembly illustrating a selective frequency filter layer and a broadband absorbing layer in accordance with an embodiment of the present disclosure.
Figure 4:
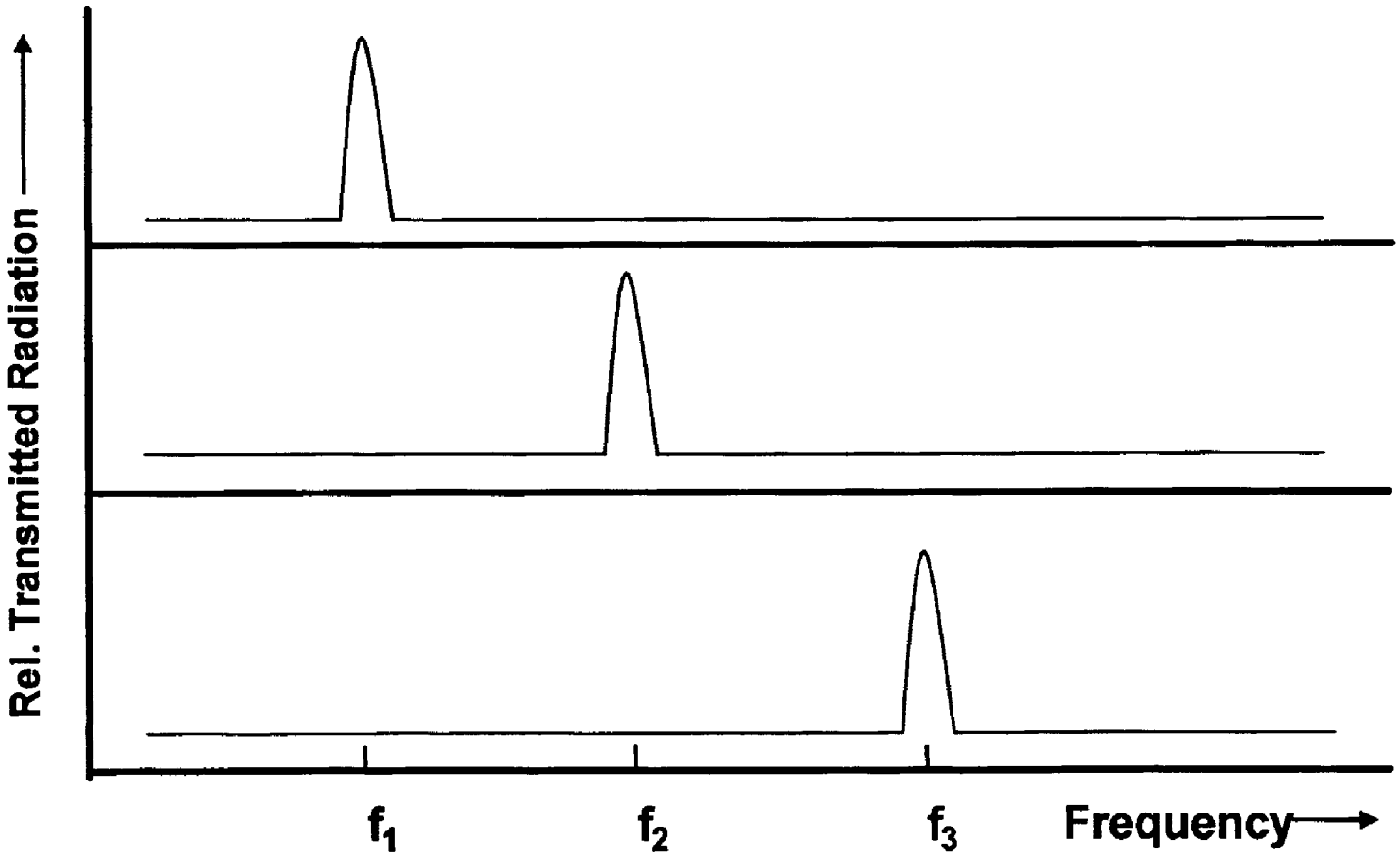
FIG. 4 is a plot of transmitted radiation performance for three frequency selection filter segments for a PM filter in accordance with an embodiment of the present disclosure.

Referring now to FIGS. 3 and 4 a perspective view of a PM filter assembly 150 illustrating a selective frequency filter layer 152 and a broadband absorbing layer 154 and a plot of transmitted radiation performance for three frequency selection filter segments 156 for a PM filter 158 are shown. Although three filter segments are shown, any number of filter segments may be incorporated.

Selective heating a segment of a front face in order to achieve light-off and regeneration in a discrete zone may be performed using the frequency filter layer 152 and the broadband absorbing layer 154. The frequency filter layer 152 may include a high-temperature reflective, electrically conductive, and metallic material that resists oxidation. The frequency filter layer 152 may include stainless steel, platinum, a super alloy, austenitic nickel-based superalloys, an iron/nickel based alloy, a noble metal, copper, etc. In one embodiment, an iron-nickel FeNi alloy with approximately 64% iron, approximately 36% nickel, and some carbon and chromium is used. The frequency filter layer 152 includes one or more open frequency select patterns that are each designed to pass an independent narrow frequency band of radiation. The three segments 156 of the frequency filter layer 152 differ in the frequency of radiation that they allow to pass through, as generally shown by reference frequencies $f_1$-$f_3$.

The broadband absorbing layer 154 absorbs the frequency energy passed through the segments 156. The term broadband may refer to a wide range of frequencies. The broadband absorbing layer 154 may include a broadband microwave absorbing material, such as Indium Tin Oxide (ITO) and Silicon Carbide. The broadband absorbing layer 154 may include one or more magnetic dipoles, electric dipoles, and semiconducting materials. The semiconducting materials may conduct at ambient temperatures. The broadband absorbing layer 154 may include oxidized materials.

FIG. 4 illustrates how microwave energy passes through at the corresponding frequencies $f_1$-$f_3$ of the three segments 156. Each of the segments 156 has a different pattern of different cuts and different spacing between cuts. The patterns of each of the segments 156 provide respective narrow band pass ranges, which are associated with the selected frequencies $f_1$-$f_3$, as shown.

Figure 5:
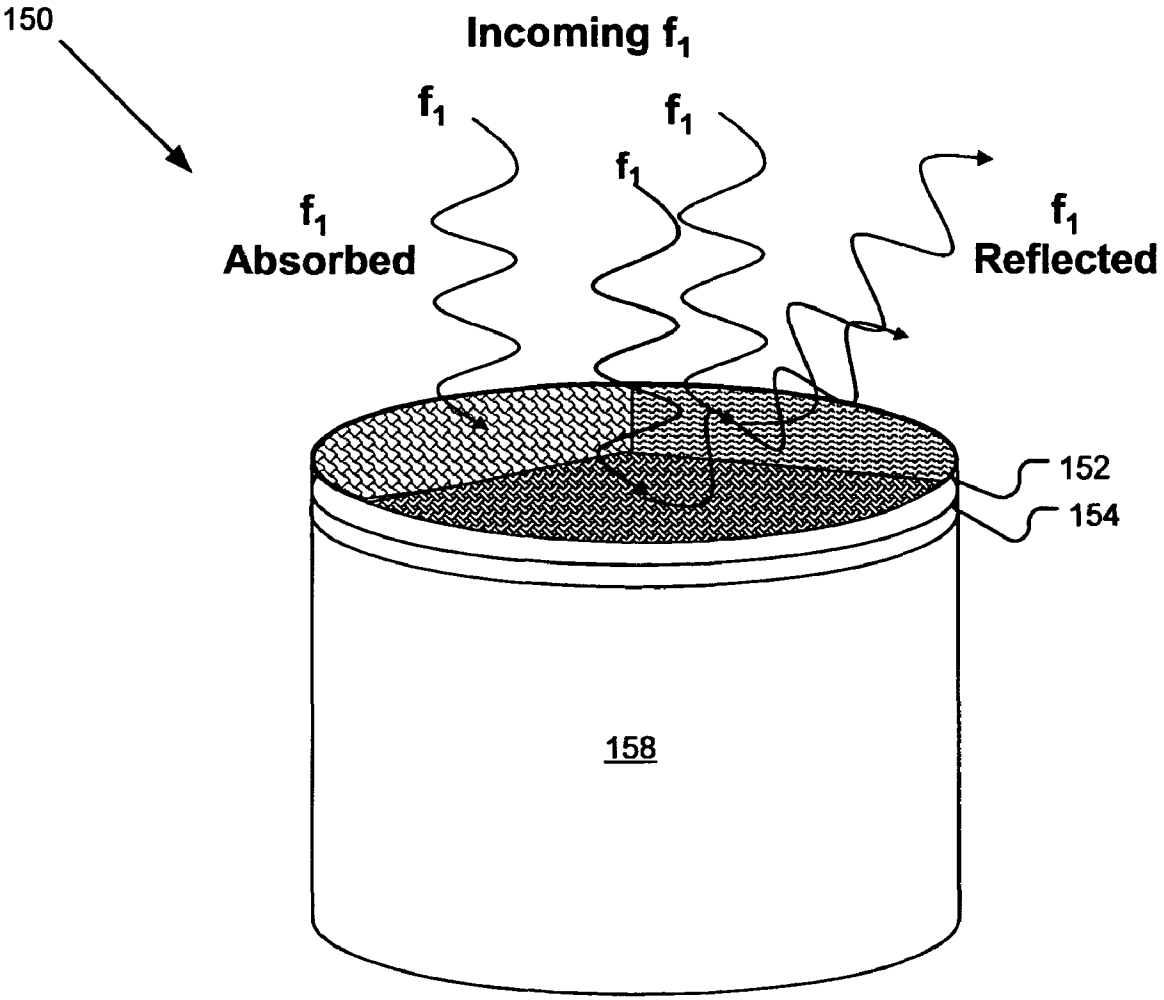
FIG. 5 is a perspective view of the PM filter assembly of FIG. 3 illustrating a first frequency absorption and reflection.
Figure 6:
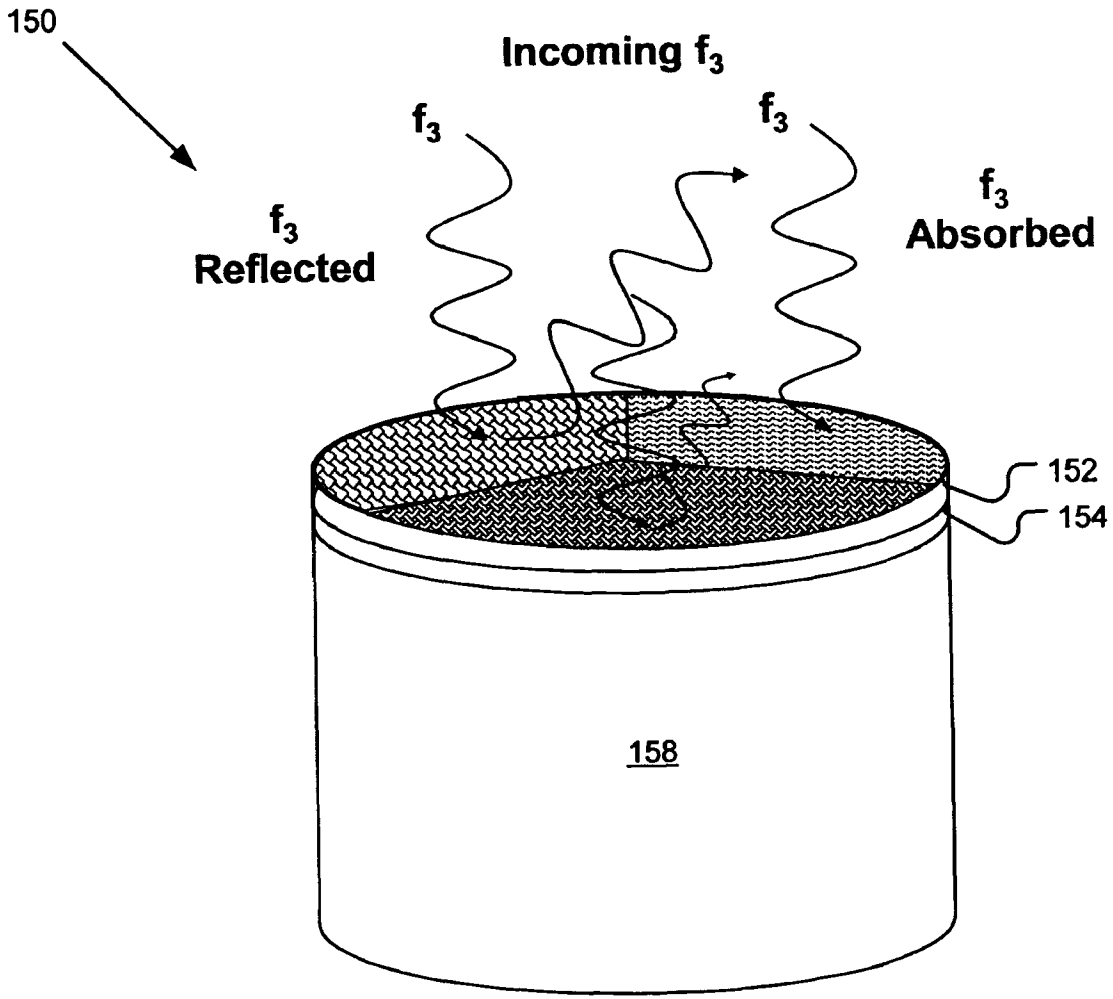
FIG. 6 is a perspective view of the PM filter assembly of FIG. 3 illustrating a third frequency absorption and reflection.

Referring now to FIGS. 5 and 6 perspective views are shown of the PM filter assembly 150 illustrating frequency absorption and reflection. Radiation having a frequency that corresponds with one of the segments passes through that segment and is reflected by the other segments.

Consequently, microwave absorption by the broadband absorbing layer 154 underneath the segment associated with frequency $f_1$ leads to light-off and regeneration of the PM filter 158 in a discrete zone defined by that segment geometry. FIG. 6 reproduces this process in a different zone of the PM filter 158 through the utilization of microwaves having the frequency $f_3$.

The microwave energy may be continuously reflected in an exhaust system upstream from the PM filter 158 until passing through the appropriate segment. Thus, little microwave energy is absorbed or lost due to reflection.

A second technique for using different frequencies of radiation for heating and regenerating discrete zones of a PM filter is through the use of a frequency selective absorber. This technique may not include a broadband microwave absorbing coating on a front face of a PM filter. Instead, a frequency selective filter is used with segments that absorb radiation at selected frequencies. The frequency selective filter may be a stand alone device or may be directly patterned onto a front face surface of a PM filter. An example of such a PM filter is described below with respect to the embodiment of FIGS. 7-9.

Figure 8:
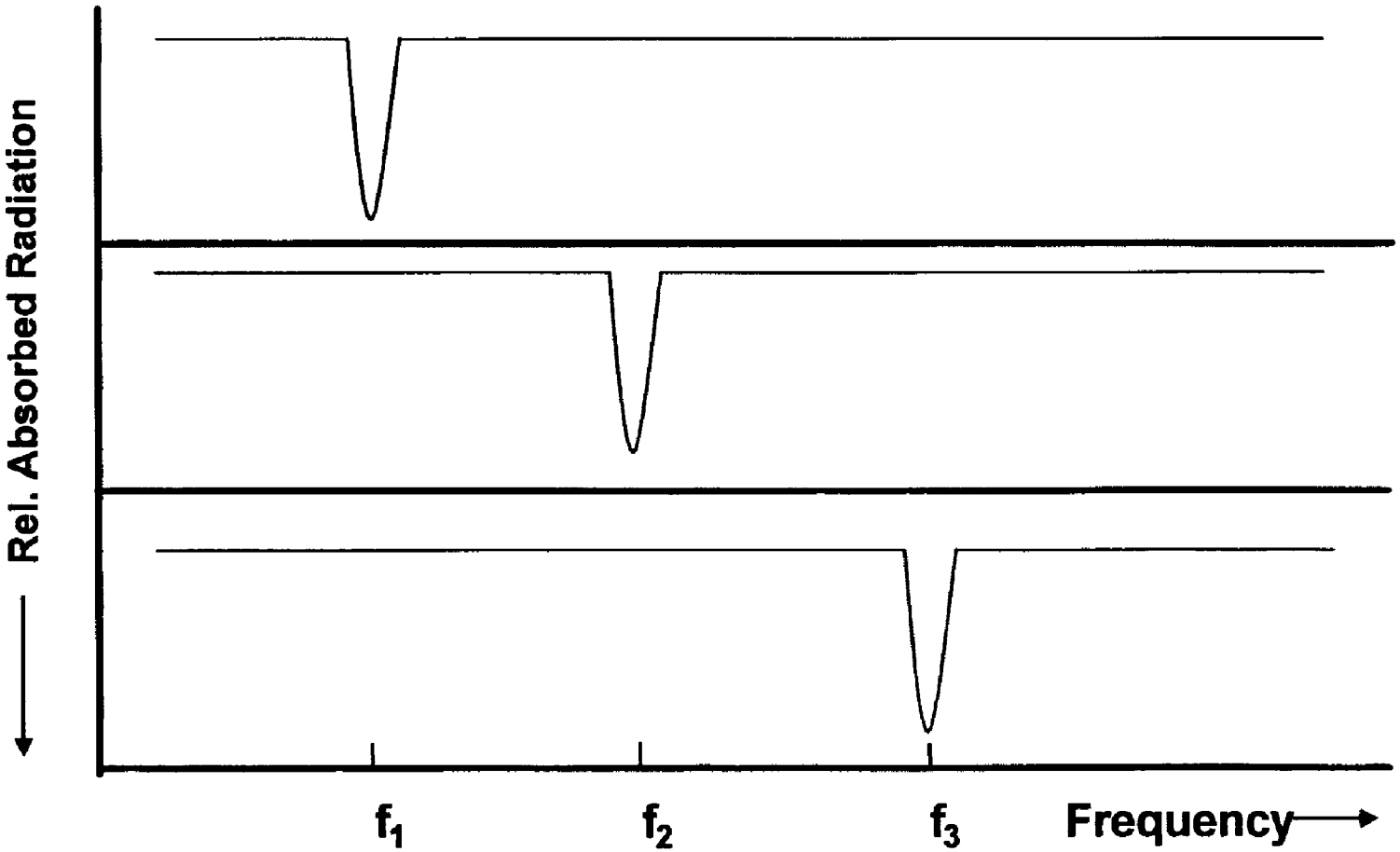
FIG. 8 is a plot of absorbed radiation performance for three frequency selection absorbers for a PM filter in accordance with an embodiment of the present disclosure.

Referring now to FIGS. 7 and 8 a perspective view of a PM filter assembly 200 with a frequency selective absorbing layer 202 and a plot of absorbed radiation performance for three frequency selective absorbers 204 for a PM filter 206 are shown. The segments 204 may be considered microwave heating elements.

The frequency selective absorber layer 202 includes materials and/or patterns that allow for selective absorption of a frequency or frequency range. Each of the segments 204 minimally absorbs microwave energy having a frequency range associated with other segments. For example, the segment associated with absorption frequency $f_1$, minimally absorbs other frequencies or frequencies outside an absorption range. Whereas, the other segments allow passage of microwave energy with the absorption frequency $f_1$. This is shown in FIG. 8.

FIG. 8 illustrates absorption properties of the frequency selective absorbing layer 202. Each of the segments 204 absorbs microwave radiation at one or more frequencies that are different than that of the other segments. The absorption selectivity results from both the pattern and choice of materials of the layer (overlay). Each of the segments 204 absorbs energy at frequencies within a narrow absorption region. Peaks of each curve in FIG. 8 are associated with the narrow absorption region and select absorption frequency, such as one of the frequencies $f_1$-$f_3$.

Referring now to FIG. 9, a perspective view of the PM filter assembly 200 is shown illustrating absorption of the first frequency $f_1$ by a first segment 208 and non-absorption of the first frequency $f_1$ by other segments 210. FIG. 9 illustrates how the frequency selective absorbing layer 202 provides heating and regeneration of individual zones of the PM filter 206. Microwave energy having the selective frequency is absorbed by a discrete zone of the PM filter 206 for light-off of that zone.

A PM filter may have a predetermined peak operating temperature. The peak operating temperature may be associated with a point of potential PM filter degradation. For example, a PM filter may begin to breakdown at operating temperatures greater than 800° C. The peak operating temperature may vary for different PM filters. The peak operating temperature may be associated with an average temperature of a portion of the PM filter or an average temperature of the PM filter as a whole.

To prevent damaging a PM filter, and thus to increase the operating life of a PM filter, the embodiments of the present disclosure may adjust PM filter regeneration based on soot loading. A target maximum operating temperature is set for a PM filter. Regeneration is performed when soot loading is less than or equal to a soot loading level associated with the maximum operating temperature. The regeneration may be performed when soot loading levels are low or within a predetermined range. The predetermined range has an upper soot loading threshold $S_{ut}$ that is associated with the maximum operating temperature. Limiting peak operating temperatures of a PM filter minimizes pressures in and expansion of the PM filter. In one embodiment, soot loading is estimated and regeneration is performed based thereon. In another embodiment, when soot loading is greater than desired for regeneration, mitigation strategies are performed to reduce PM filter peak temperatures during regeneration.

Soot loading may be estimated from parameters, such as mileage, exhaust pressure, exhaust drop off pressure across a PM filter, by a predictive method, etc. Mileage refers to vehicle mileage, which approximately corresponds to or can be used to estimate vehicle engine operating time and/or the amount of exhaust gas generated. As an example, regeneration may be performed when a vehicle has traveled approximately 200-300 miles. The amount of soot generated depends upon vehicle operation over time. At idle speeds less soot is generated than when operating at travel speeds. The amount of exhaust gas generated is related to the state of soot loading in the PM filter.

Exhaust pressure can be used to estimate the amount of exhaust generated over a period of time. When an exhaust pressure exceeds a predetermined level or when an exhaust pressure decreases below a predetermined level, regeneration may be performed. For example when exhaust pressure entering a PM filter exceeds a predetermined level, regeneration may be performed. As another example when exhaust pressure exiting a PM filter is below a predetermined level, regeneration may be performed.

Exhaust drop off pressure may be used to estimate the amount of soot in a PM filter. For example, as the drop off pressure increases the amount of soot loading increases. The exhaust drop off pressure may be determined by determining pressure of exhaust entering a PM filter minus pressure of exhaust exiting the PM filter. Exhaust system pressure sensors may be used to provide these pressures.

A predictive method may include the determination of one or more engine operating conditions, such as engine load, fueling schemes, fuel injection timing, and exhaust gas recirculation (EGR). A cumulative weighting factor may be used based on the engine conditions. The cumulative weighting factor is related to soot loading. When the cumulative weighting factor exceeds a threshold, regeneration may be performed.

Based on the estimated soot loading and a known peak operating temperature for a PM filter, regeneration is performed to prevent the PM filter from operating at temperatures above the peak operating temperature.

Designing a control system to target a selected soot loading allows PM filter regenerations without intrusive controls. A robust regeneration strategy as provided herein, removes soot from a PM filter, while limiting peak operating temperatures. Limiting of peak operating temperatures reduces thermal stresses on a substrate of a PM filter and thus prevents damage to the PM filter, which can be caused by high soot exotherms. Durability of the PM filter is increased.

When soot loading is greater than a threshold level associated with a set peak regeneration temperature, mitigation strategies may be performed to reduce PM filter peak temperatures during regeneration. For example, when a maximum soot loading threshold is set at approximately 2 g/l and current soot loading is 4 g/l, to minimize temperatures within a PM filter during regeneration engine operation is adjusted. The adjustment may include oxygen control and exhaust flow control.

Soot loading may be greater than an upper threshold level, for example, when an engine is operated to receive a high intake air flow rate for an extended period of time. Such operation may occur on a long freeway entrance ramp or during acceleration on a freeway. As another example, a soot loading upper threshold may be exceeded when throttle of an engine is continuously actuated between full ON and full OFF for an extended period of time. High air flow rates can prevent or limit regeneration of a PM filter.

During oxygen control, the amount of oxygen entering the PM filter is decreased to decrease the exotherm temperatures of the PM filter during regeneration. To decrease oxygen levels airflow may be decreased, EGR may be increased, and/or fuel injection may be increased. The fuel injection may be increased within engine cylinders and/or into the associated exhaust system. The burning of more fuel decreases the amount of oxygen present in the exhaust system.

A large increase in exhaust flow can aid in distinguishing or minimizing an exothermic reaction in a PM filter. Exhaust flow control may include an increase in exhaust flow by a downshift in a transmission or by an increase in idle speed. The increase in engine speed increases the amount of exhaust flow.

FIG. 10 is a flowchart illustrating steps performed by the control module to regenerate a zoned PM filter that has microwave heating elements is shown. Although the following steps are primarily described with respect to the embodiments of FIGS. 1-9, the steps may be easily modified to apply to other embodiments of the present disclosure.

In step 300, control of a control module, such as the control module 44, begins and proceeds to step 301. In step 301, sensor signals are generated. The sensor signals may include an exhaust flow signal, an exhaust temperature signal, exhaust pressure signal, oxygen signal, intake air flow signal, intake air pressure signal, intake air temperature signal, engine speed signal, an EGR signal, etc., which may be generated by the above-described sensors.

In step 302, control estimates current soot loading $S_l$ of the PM filter. Control may estimate soot loading as described above. The estimation may be based on vehicle mileage, exhaust pressure, exhaust drop off pressure across the PM filter, and/or a predictive method. The predictive method may include estimation based on one or more engine operating parameters, such as engine load, fueling schemes, fuel injection timing, and EGR. In step 303, control determines whether the current soot loading $S_l$ is greater than a soot loading lower threshold $S_{lt}$. When the current soot loading $S_l$ is greater than the lower threshold $S_{lt}$ control proceeds to step 304, otherwise control returns to step 302.

In step 304, control determines whether current soot loading $S_l$ is less than a soot loading upper threshold $S_{ut}$. When the current soot loading $S_l$ is less than the upper threshold $S_{ut}$ then control proceeds to step 308. When the current soot loading $S_l$ is greater than or equal to the upper threshold $S_{ut}$ then control proceeds to both steps 308 and 310. In step 310, control performs mitigation strategies as described above to limit peak temperatures in the PM filter during regeneration. Step 310 is performed while performing regeneration steps 312-324.

If control determines that regeneration is needed in step 304, control selects one or more zones in step 308 and activates a microwave source to generate microwave energy with frequencies to heat the selected zone(s) in step 312. The microwave source may be activated to generate 1000-7000 watts of microwave energy for approximately 30-90 s.

The PM filter is regenerated by selectively heating one or more of the zones in the PM filter and igniting the soot using wireless microwave heating. When soot within the selected zones reaches a regeneration temperature, the microwave source may be turned off and the burning soot then cascades down the PM filter, which is similar to a burning fuse on a firework. In other words, the microwave source may be activated only long enough to start the soot ignition and is then shut off. Other regeneration systems typically use both conduction and/or convection and maintain power to a heater (at lower temperatures such as 600 degrees Celsius) throughout the soot burning process. As a result, these systems tend to use more power than the system proposed in the present disclosure.

In one embodiment, radially outer most zones are regenerated first followed by radially inner zones. The zones may be regenerated in a select, predetermined, sequential, independent, or arbitrary manner. Multiple zones may be selected and heated during the same time period.

In step 315, control may determine current and/or voltage to supply a microwave source and/or frequency of microwave energy out of the microwave source. The current, voltage and/or frequency may be predetermined and stored in a memory, determined via a look-up table, or determined based on engine operating parameters, some of which are stated herein.

In step 316, control estimates a heating period sufficient to achieve a minimum soot temperature based on at least one of current, voltage, exhaust flow, exhaust temperature and predetermined microwave circuit characteristics, such as output power and frequency of a microwave circuit. The heating period may also be based on characteristics of the microwave heating elements, such as absorption and reflection characteristics. The minimum soot temperature should be sufficient to start the soot burning and to create a cascade effect. For example only, the minimum soot temperature may be set to 700 degrees Celsius or greater. In an alternate step 320 to step 316, control estimates current and voltage needed to achieve minimum soot temperatures based on a predetermined heating period, exhaust flow and exhaust temperature.

In step 324, control determines whether the heating period is up. If step 324 is true, control determines whether additional zones need to be regenerated in step 326. If step 326 is true, control returns to step 308.

The burning soot is the fuel that continues the regeneration. This process is continued for each heating zone until the PM filter is completely regenerated. Control ends in step 328.

The above described method provides microwave heating of zones of a PM filter while reducing spontaneous power consumption in the PM filter and thus improves robustness and life of the PM filter.

In use, the control module determines when the PM filter requires regeneration. The determination is based on soot levels within the PM filter. Alternately, regeneration can be performed periodically or on an event basis. The control module may estimate when the entire PM filter needs regeneration or when zones within the PM filter need regeneration. When the control module determines that the entire PM filter needs regeneration, the control module sequentially activates one or more of the zones at a time to initiate regeneration within the associated downstream portion of the PM filter. After the zone or zones are regenerated, one or more other zones are activated while the others are deactivated. This approach continues until all of the zones have been activated. When the control module determines that one of the zones needs regeneration, the control module activates the zone corresponding to the associated downstream portion of the PM filter needing regeneration.

FIG. 11 is a flowchart illustrating steps performed in manufacturing a PM filter with microwave heating elements In step 350, a front face of a PM filter is dipped into a slurry or bath of an aqueous solution. The aqueous solution includes a microwave energy absorbing material, such as ITO or silicon carbide, which is suspended in the solution.

In step 352, the PM filter is removed from the bath and excess coating material is removed.

In step 354, the PM filter is dried. The PM filter may be dried at temperature of, for example, approximately 100° C.

In step 356, the coating applied to and remaining on the PM filter is solidified, consolidated and bonded to the PM filter. The solidification may be facilitated by baking. The PM filter may be baked at, for example approximately 650° C., for a predetermined period of time.

The above-described steps of FIGS. 10 and 11 are meant to be illustrative examples; the steps may be performed sequentially, synchronously, simultaneously, continuously, during overlapping time periods or in a different order depending upon the application.

The present disclosure provides a low power regeneration technique with short regeneration periods and thus overall regeneration time of a PM filter. The present disclosure may substantially reduce the fuel economy penalty, decrease tailpipe temperatures, and improve system robustness due to the smaller regeneration time.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An assembly comprising:

a particulate matter (PM) filter that comprises an upstream end for receiving exhaust gas, a downstream end and a plurality of zones;

an absorbing layer that absorbs microwave energy in one of N frequency ranges and that is arranged with said upstream end, where N is an integer greater than 1; and a frequency selective filter that has M frequency selective segments and that receives microwave energy in said N frequency ranges, where M is an integer greater than 1, wherein one of said M frequency selective segments permits passage of said microwave energy in one of said N frequency ranges and not in the other of said N frequency ranges.

2. The assembly of claim 1 wherein said absorbing layer comprises at least one of indium tin oxide and silicon carbide.

3. The assembly of claim 1 wherein said absorbing layer comprises at least one of a magnetic dipole and an electric dipole.

4. The assembly of claim 1 wherein each of said M frequency selective segments has an associated band pass frequency range.

5. The assembly of claim 4 wherein said M frequency selective segments comprise frequency selective patterns.

6. The assembly of claim 1 wherein said frequency selective filter comprises:

a first frequency selective segment that allows passage of microwave energy within a first frequency range; and a second frequency selective segment that allows passage of microwave energy within a second frequency range that is different than said first frequency range.

7. The assembly of claim 6 wherein said first frequency selective segment prevents passage of microwave energy within said second frequency range, and wherein said second frequency selective segment prevents passage of microwave energy within said first frequency range.

8. The assembly of claim 1 wherein said frequency selective filter comprises reflective, electrically conductive, and metallic materials.

9. A system comprising the assembly of claim 1 and further comprising:

an antenna coupled to said PM filter;

a microwave generator that generates microwaves; and a waveguide that transports said microwaves to said antenna.

10. The system of claim 9 further comprising a control module that selectively heats said zones via said microwave generator.

11. An assembly comprising:

a particulate matter (PM) filter comprises an upstream end for receiving exhaust gas, a downstream end and a plurality of zones; and a frequency selective absorbing filter that is arranged with said upstream end, that receives said exhaust gas, that absorbs microwave energy in one of N frequency ranges, and that permits transmission of microwave energy in the other of said N frequency ranges into said PM filter, where N is an integer greater than 1, wherein said frequency selective absorbing filter comprises M frequency selective absorbing segments, wherein one of said frequency selective absorbing segments absorbs microwave energy in said one of N frequency ranges, and wherein the other of said M frequency selective absorbing segments permits transmission of microwave energy in said other of said N frequency ranges, where M is an integer greater than 1.

12. An assembly comprising:

a particulate matter (PM) filter comprises an upstream end for receiving exhaust gas, a downstream end and a plurality of zones; and a frequency selective absorbing filter that is arranged with said upstream end, that receives said exhaust gas, that absorbs microwave energy in one of N frequency ranges, and that permits transmission of microwave energy in the other of said N frequency ranges into said PM filter, where N is an integer greater than 1, wherein said frequency selective absorbing filter comprises:

a first frequency selective absorbing segment that absorbs microwave energy within a first frequency range; and a second frequency selective absorbing segment that absorbs microwave energy within a second frequency range that is different than said first frequency range.

13. The assembly of claim 12 wherein said first frequency selective absorbing segment permits passage of microwave energy within said second frequency range, and wherein said second frequency selective absorbing segment permits passage of microwave energy within said first frequency range.

14. A system comprising the assembly of claim 11 and further comprising:

an antenna coupled to said PM filter;

a microwave generator that generates microwaves; and a waveguide that transports said microwaves to said antenna.

15. The system of claim 14 further comprising a control module that selectively heats said zones via said microwave generator.

16. A method comprising:

receiving an exhaust gas via a particulate matter (PM) filter that has an upstream end, a downstream end and a plurality of zones;

generating microwave energy in one of N frequency ranges, where N is an integer greater than 1;

permitting absorption of said microwave energy in association with a first zone of said PM filter;

limiting microwave energy absorption in association with a second zone of said PM filter;

generating microwave energy in a first frequency range to regenerate said first zone; and generating microwave energy in a second frequency range that is different than said first frequency range to regenerate said second zone.

17. The method of claim 16 wherein limiting microwave energy absorption in association with said second zone comprises reflecting said microwave energy to prevent entrance into said second zone.

18. The method of claim 16 wherein limiting microwave energy absorption in association with said second zone comprises permitting passage of said microwave energy through said second zone.

19. The method of claim 16 further comprising:

allowing passage of microwave energy within a first frequency range to said PM filter via a first frequency selective segment upstream from said PM filter; and allowing passage of microwave energy within a second frequency range to said PM filter via a second frequency selective segment upstream from said PM filter, wherein said second frequency range is different than said first frequency range.

* * * * *